United States Patent [19]

Brisbane et al.

[11] Patent Number: 4,539,963

[45] Date of Patent: Sep. 10, 1985

[54] SHAFT MOUNTED VALVE POSITION SENSOR

[75] Inventors: Roger M. Brisbane, Spencerport; Thomas R. Peffley, Rochester, both of N.Y.

[73] Assignee: General Motors Corporation, Detroit, Mich.

[21] Appl. No.: 670,268

[22] Filed: Nov. 13, 1984

[51] Int. Cl.[3] ..... F02M 63/00

[52] U.S. Cl. ..... 123/494; 73/118

[58] Field of Search ..... 123/339, 494; 73/118; 338/184

[56] References Cited

U.S. PATENT DOCUMENTS 4,430,634 2/1984 Hufford et al. ..... 338/164

OTHER PUBLICATIONS

1984 Buick Chassis Service Manual, pp. 6C13-1 through 6C13-11 and 6C15-1 through 6C15-12.

*Primary Examiner*—Tony M. Argenbright

*Attorney, Agent, or Firm*—C. K. Veenstra

[57] ABSTRACT

In a throttle body fuel injection assembly, the rotor of a throttle position sensor is mounted directly on the throttle shaft and the sensor housing is supported on the rotor, thereby providing a compact sensor construction. A spring in the sensor tends to impart relative rotation between the rotor and the housing, biasing the housing toward engagement with the throttle body. With this invention, the housing rotates with the rotor away from engagement with the throttle body if the spring does not impart relative rotation between the housing and the rotor.

3 Claims, 8 Drawing Figures

SHAFT MOUNTED VALVE POSITION SENSOR

TECHNICAL FIELD

This invention relates to a valve position sensor suitable for measuring the position of a throttle in an automotive engine air induction passage.

BACKGROUND

To measure the position of a throttle in an engine air induction passage, some automotive electronic control systems incorporate a sensor such as that illustrated generally by U.S. Pat. No. 4,430,634. The sensor has a housing bolted to the throttle body and a rotor operated from the throttle shaft through a pair of levers. Throttle position is measured by the relative rotative position of the rotor in the housing.

SUMMARY OF THE INVENTION

This invention provides a valve position sensor, suitable for use as a throttle position sensor, which is not secured to the valve body but instead is mounted directly on the valve shaft. Accordingly, this invention provides a valve position sensor which is more compact and more easily installed than the prior throttle position sensors.

In a valve position sensor employing this invention, a rotor is secured directly on the valve shaft and a housing is rotatably supported on the rotor. A spring tending to impart relative rotation between the rotor and the housing biases the housing toward engagement with the valve body. Rotation of the valve shaft as the position of the valve is varied is accompanied by rotation of the rotor in the housing to provide a measure of the valve position. The housing may rotate with the rotor away from engagement with the valve body as the valve is rotated toward the closed position in the event the spring does not impart relative rotation between the housing and the rotor. Moreover, the spring has a reaction through the housing against the valve body biasing the rotor and the valve shaft and the valve toward the closed position.

The details as well as other features and advantages of a preferred embodiment of this invention are set forth in the remainder of the specification and are shown in the accompanying drawings.

THE PREFERRED EMBODIMENT

Figure 1:
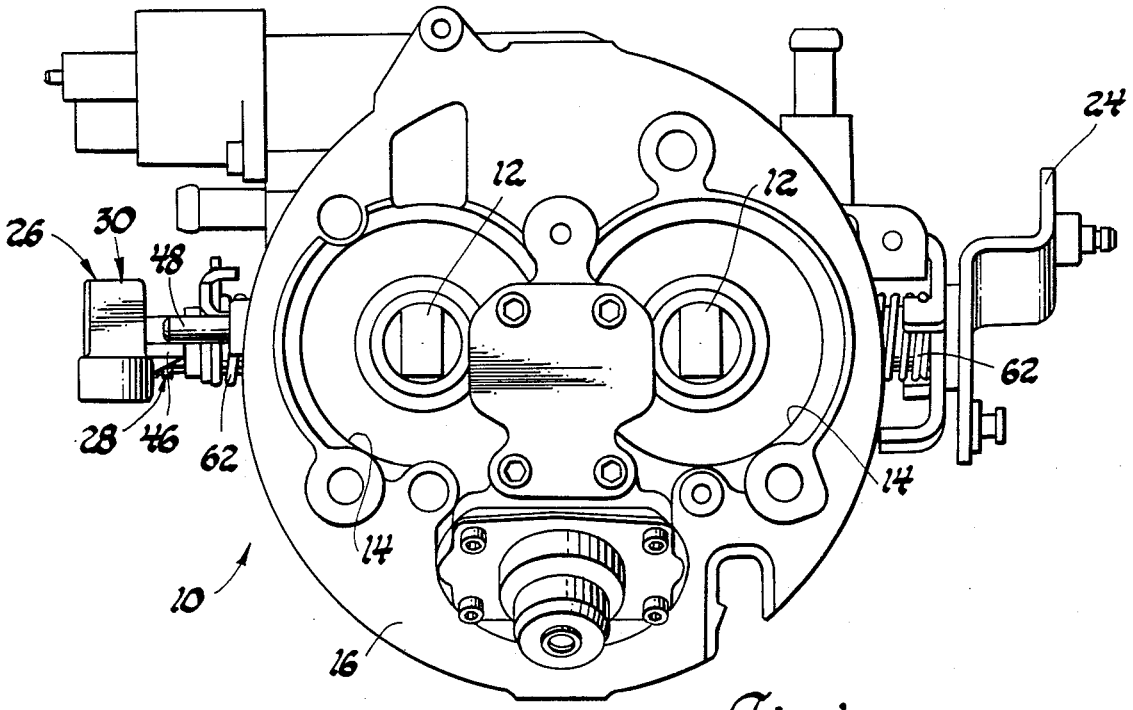
FIG. 1 is a plan view of a throttle body fuel injection assembly having a throttle position sensor according to this invention.
Figure 2:
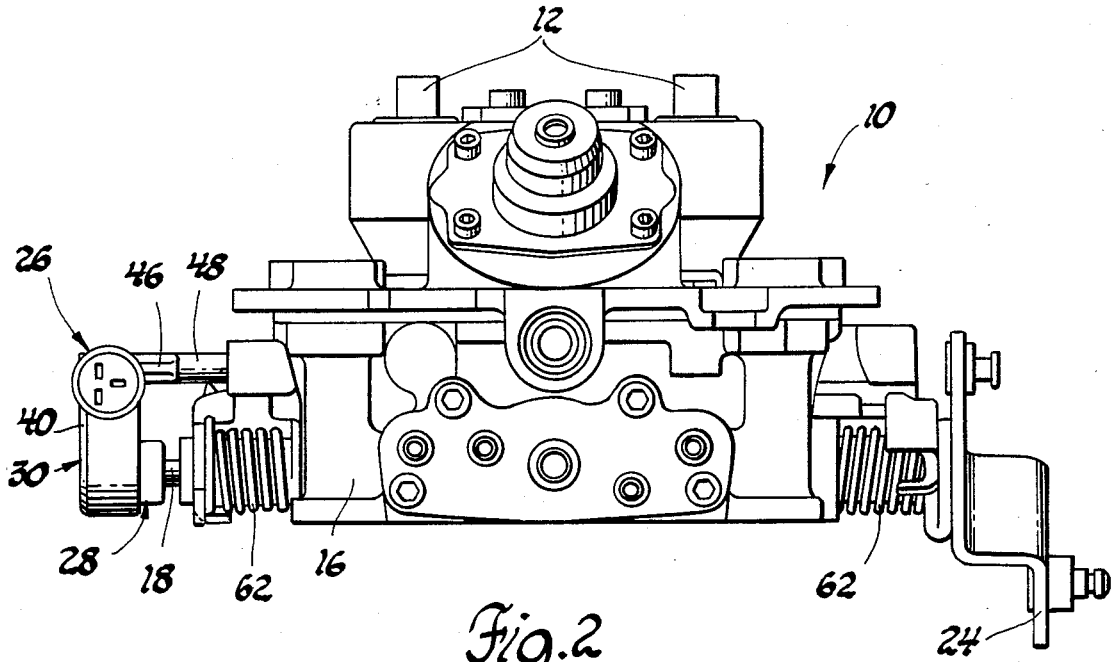
FIG. 2 is an elevational view of the FIG. 1 assembly further showing the relationship of the throttle position sensor to the throttle body.
Figure 3:
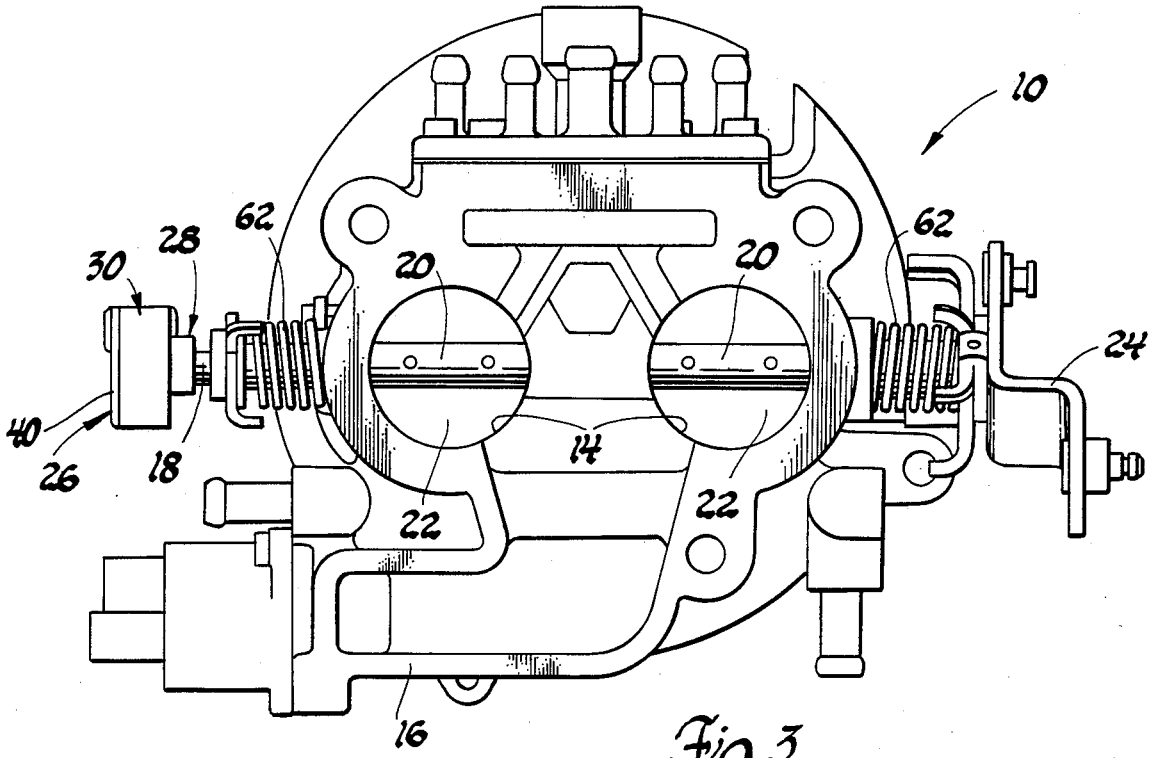
FIG. 3 is a bottom view of the FIG. 1 assembly showing the relationship of the throttle position sensor to the remainder of the throttle system.

Referring first to FIGS. 1–3 of the drawings, a throttle body fuel injection assembly 10 has a pair of fuel injectors 12 suspended above a pair of air induction passages 14 defined in an air inlet or throttle body 16. A throttle shaft 18 is rotatably supported in throttle body 16 and has a portion 20 extending into induction passages 14. A throttle 22 is secured to shaft 18 within each induction passage 14, and a throttle lever 24 is secured to one end of shaft 18. Operation of throttle lever 24 rotates shaft 18 and throttles 22 between open and closed positions to vary the area available for air flow through induction passages 14.

Figure 6:
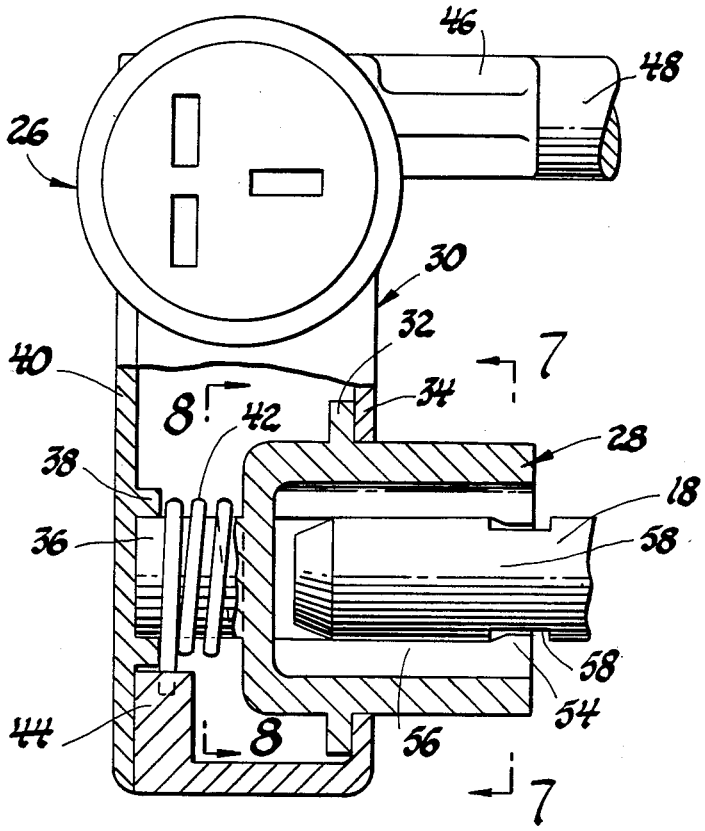
FIG. 6 is an enlarged view of a portion of FIG. 2 with parts broken away, exemplifying an internal construction of the throttle position sensor.
Figure 7:
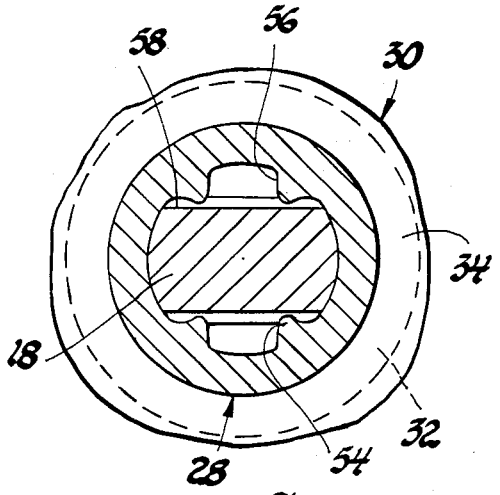
FIG. 7 is a view in the direction indicated by the line 7—7 of FIG. 6 showing the throttle position sensor rotor secured on the throttle shaft.
Figure 8:
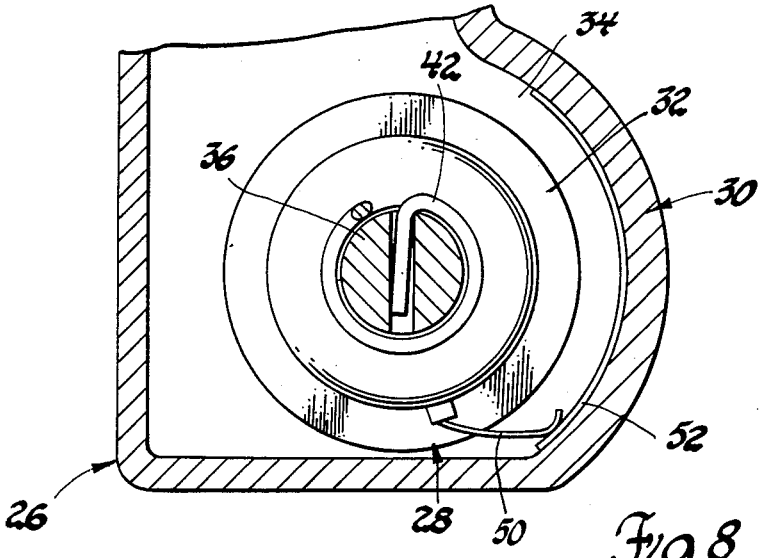
FIG. 8 is a view in the direction indicated by the line 8—8 of FIG. 6 further exemplifying an internal construction of the throttle position sensor.

A throttle position sensor 26 is mounted on the end of throttle shaft 18 opposite throttle lever 24. As shown in FIGS. 6–8, sensor 26 includes a rotor 28 pressed onto the double-D shaped configuration of the end of shaft 18 and a housing 30 supported on rotor 28. Rotor 28 has a flange 32 riding on the base 34 of housing 30 and a nose 36 received in a boss 38 formed in the cover 40 of housing 30.

Figure 4:
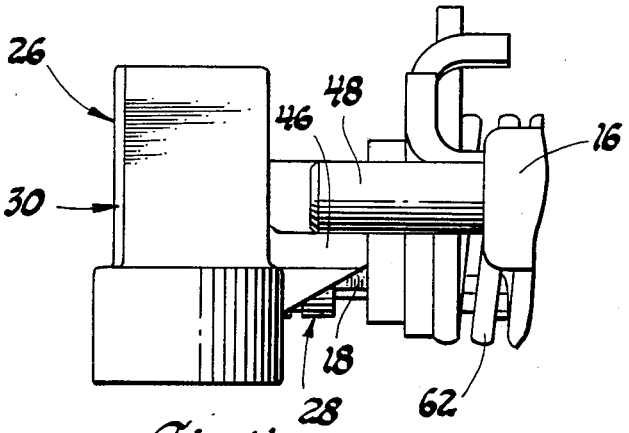
FIG. 4 is an enlarged view of a portion of FIG. 1 showing the engagement of the throttle position sensor housing with the throttle body.

Nose 36 is slotted to receive one end of a torsion spring 42, and the other end of torsion spring 42 engages an abutment 44 formed in housing 30. Spring 42 provides a bias tending to impart relative rotation between housing 30 and rotor 28. The reaction of spring 42 through rotor 28 against throttle shaft 18 biases housing 30 counter-clockwise (as viewed in FIG. 8) with respect to rotor 28 to engage an arm 46 of housing 30 with a pin 48 on throttle body 16 (see FIG. 4). And the reaction of spring 42 through housing 30 against throttle body pin 48 biases rotor 28 and shaft 18 and throttles 22 toward the closed position.

A potentiometer including a rake 50 carried by rotor 28 and a wiper strip 52 supported in housing 30 measures the relative rotative position of rotor 28 in housing 30 to thereby provide a measure of the position of throttles 22 in induction passages 14.

To assemble sensor 26 to shaft 18, rotor 28 is pressed on shaft 18 whereupon the inwardly projecting tabs 54 on internal ridges 56 snap over the end of shaft 18 and into a pair of slots 58 formed in shaft 18, thereby retaining rotor 28 and thus sensor 26 on shaft 18. Spring 42 then rotates housing 30 to engage arm 46 with throttle body pin 48.

Figure 5:
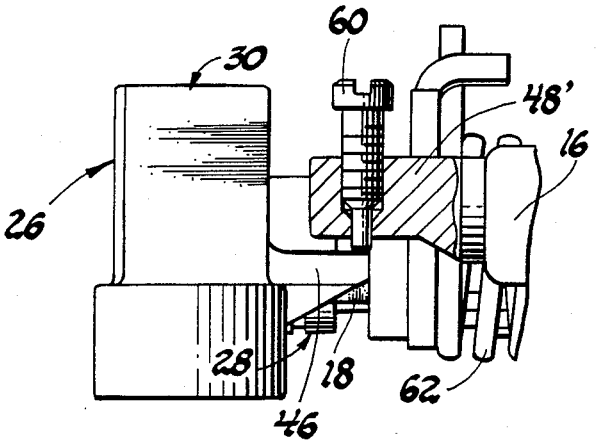
FIG. 5 is a view similar to FIG. 4 showing the throttle position sensor housing engaged with an adjusting screw carried by the throttle body.

If desired, pin 48 may be replaced by an adjusting screw 60 mounted in a stud 48' carried by throttle body 16 as shown in FIG. 5. By moving adjusting screw 60 in or out, the relative rotative position of housing 30 on rotor 28 may be varied to calibrate the potentiometer output.

In the event spring 42 does not impart relative rotation between housing 30 and rotor 28 as throttle return springs 62 rotate rotor 28 and shaft 18 and throttles 22 toward the closed position, housing 30 will rotate with rotor 28, disengaging housing arm 46 from throttle body pin 48 or adjusting screw 60, to allow closure of throttles 22.

The embodiments of the invention in which an exclusive property or privilege is claimed are defined as follows:

1. In an assembly including a body defining a passage for fluid flow, a shaft rotatably supported in said body and having a portion extending into said passage, a valve secured on said portion of said shaft, said valve being rotatable with said shaft between open and closed positions to determine the area available for flow through said passage, and a valve position sensor having a housing, a rotor disposed in said housing, means for measuring the relative rotative position of said rotor in said housing, and a spring providing a bias for imparting relative rotation between said rotor and said housing, the improvement wherein said rotor is secured on said shaft, said housing is rotatably supported on said rotor and is engageable with said body, and said spring has a reaction through said rotor against said shaft biasing said housing toward engagement with said body, whereby rotation of said shaft in said body as the position of said valve is varied in said passage is accompanied by rotation of said rotor in said housing to thereby provide a measure of the position of said valve in said passage, and whereby said housing may rotate with said rotor away from engagement with said body as said valve is rotated toward said closed position in the event the bias of said spring does not impart relative rotation between said housing and said rotor, and wherein said spring further has a reaction through said housing against said body biasing said rotor and said shaft and said valve toward said closed position.

2. In an assembly including an air inlet body defining a passage for engine air flow, a shaft rotatably supported in said body and having a portion extending into said passage, a valve secured on said portion of said shaft, said valve being rotatable with said shaft between open and closed positions to determine the area available for air flow through said passage, and a valve position sensor having a housing, a rotor disposed in said housing, means for measuring the relative rotative position of said rotor in said housing, and a spring providing a bias for imparting relative rotation between said rotor and said housing, the improvement wherein said rotor is secured on said shaft, said housing is rotatably supported on said rotor and is engageable with said body, and said spring has a reaction through said rotor against said shaft biasing said housing toward engagement with said body, whereby rotation of said shaft in said body as the position of said valve is varied in said passage is accompanied by rotation of said rotor in said housing to thereby provide a measure of the position of said valve in said passage, and whereby said housing may rotate with said rotor away from engagement with said body as said valve is rotated toward said closed position in the event the bias of said spring does not impart relative rotation between said housing and said rotor, and wherein said spring further has a reaction through said housing against said body biasing said rotor and said shaft and said valve toward said closed position.

3. In an assembly including an air inlet body defining a passage for engine air flow, a shaft rotatably supported in said body and having a portion extending into said passage, a throttle valve secured on said portion of said shaft, said valve being rotatable with said shaft between open and closed positions to limit the area available for air flow through said passage, and a valve position sensor having a housing, a rotor disposed in said housing, means for measuring the relative rotative position of said rotor in said housing, and a spring providing a bias for imparting relative rotation between said rotor and said housing, the improvement wherein said rotor is secured on said shaft, said housing is rotatably supported on said rotor and is engageable with said body, and said spring has a reaction through said rotor against said shaft biasing said housing toward engagement with said body, whereby rotation of said shaft in said body as the position of said valve is varied in said passage is accompanied by rotation of said rotor in said housing to thereby provide a measure of the position of said valve in said passage, and whereby said housing may rotate with said rotor away from engagement with said body as said valve is rotated toward said closed position in the event the bias of said spring does not impart relative rotation between said housing and said rotor, and wherein said spring further has a reaction through said housing against said body biasing said rotor and said shaft and said valve toward said closed position.

* * * * *